United States Patent [19]

Thrash

[11] Patent Number: 4,670,944

[45] Date of Patent: Jun. 9, 1987

[54] LIGNOCELLULOSE COMMINUTION AND CLASSIFICATION

[75] Inventor: Tommy K. Thrash, Littlefield, Tex.

[73] Assignee: Sunbelt America Corporation, Littlefield, Tex.

[21] Appl. No.: 676,051

[22] Filed: Nov. 29, 1984

[51] Int. Cl.[4] ..... D01B 1/08; B02B 5/00

[52] U.S. Cl. ..... 19/58; 19/80 R; 19/100; 19/107; 19/200; 241/7; 241/9; 241/11; 241/24; 209/930; 110/222

[58] Field of Search ..... 241/7, 9, 11, 24, 28; 19/58, 80 R, 200, 202, 203, 100, 107; 209/930; 110/222

[56] References Cited

U.S. PATENT DOCUMENTS

| | | | |
|---|---|---|---|
| 1,199,621 | 9/1916 | Sheppard | 241/11 |
| 2,136,506 | 11/1938 | Horn | 19/72 |
| 2,143,306 | 1/1939 | Earle | 241/9 |
| 2,300,978 | 11/1942 | Sheppard | 19/67 |
| 3,769,660 | 11/1973 | Schuette, Jr. | 19/202 |
| 4,214,348 | 7/1980 | Schwartz et al. | 19/203 |
| 4,229,286 | 10/1980 | Bridges | 209/22 |
| 4,300,267 | 11/1981 | Winch et al. | 19/200 |
| 4,310,950 | 1/1982 | Cox | 19/202 |
| 4,338,705 | 7/1982 | Jones | 19/80 R |
| 4,397,065 | 8/1983 | Bettoni et al. | 19/80 R |
| 4,441,232 | 4/1984 | Underbrink et al. | 19/48 R |

FOREIGN PATENT DOCUMENTS

| | | | |
|---|---|---|---|
| 564448 | 9/1949 | United Kingdom | 241/7 |
| 2040190 | 8/1980 | United Kingdom | 241/9 |
| 0683801 | 9/1979 | U.S.S.R. | 241/7 |

OTHER PUBLICATIONS

Cotton Ginners Handbook, Agriculture Handbook #503, pp. i, ii, iii, 19–96.

Cotton Ginning Systems in the U.S. and Auxilliary Developments, Bennett, 1962.

*Primary Examiner*—John E. Kittle

*Assistant Examiner*—Patrick J. Ryan

*Attorney, Agent, or Firm*—Wendell Coffee

[57] ABSTRACT

Cotton burrs and other trash from a cotton gin are processed by first passing them over a small screen to remove sand and other fine material. Thereafter, the burrs and other trash are ground in a hammer mill. After grinding, the material passed along a large screen having about ⅜" opening. Substantially all the burrs and trash will pass through the screen except for cotton lint which will not. The burrs and trash, without the lint, is then sized by screening through screens with successively smaller openings. The burrs and trash of any one size is further separated by air classification. The resulting product is a combination of three geometric shapes, fibers, flakes, and granules. The resulting product is a lignocellulose product having softwood lignin precursors.

11 Claims, 7 Drawing Figures

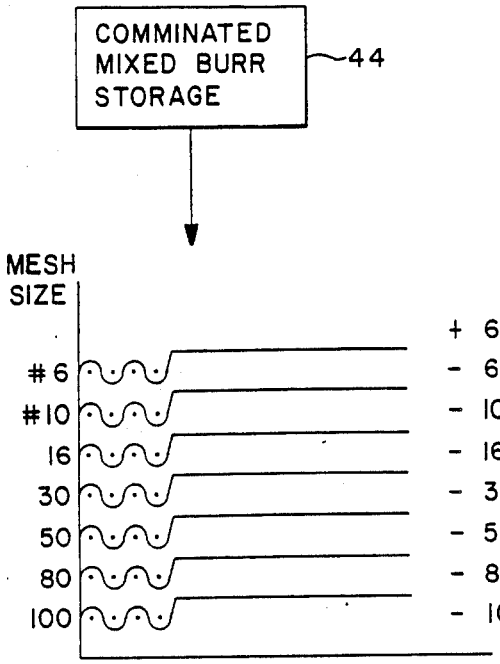
FIG. 6
| PARTICLE SIZE | / | AMOUNT | |
|---|---|---|---|
| + 6 | = | 2.0% | |
| - 6 + 10 | = | 9.1% | |
| - 10 + 16 | = | 20.1% | |
| - 16 + 30 | = | 22.2% | |
| - 30 + 50 | = | 23.6% | |
| - 50 + 80 | = | 13.2% | 23% |
| - 80 + 100 | = | 5.7% | 23% |
| - 100 | = | 4.1% | 23% |
FIG. 7
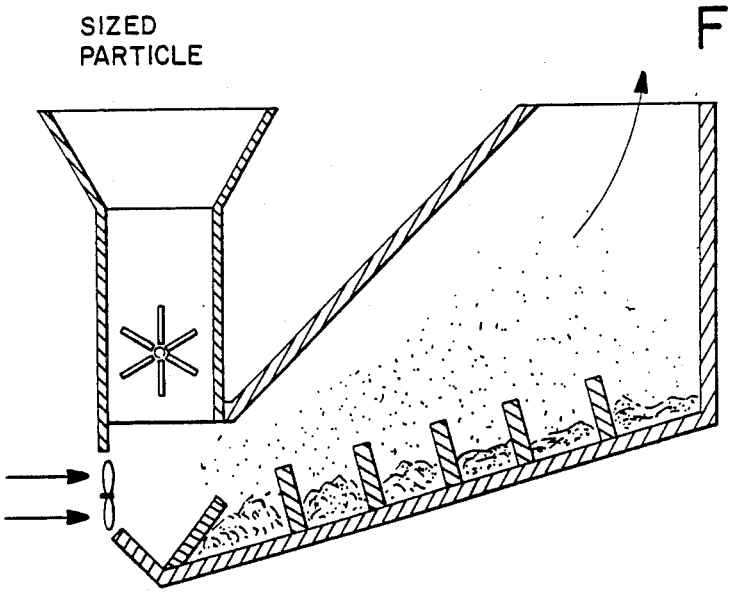

LIGNOCELLULOSE COMMINUTION AND CLASSIFICATION

CROSS REFERENCE TO RELATED APPLICATION

None. However, Applicant or the owner of this application has filed the following Disclosure Documents:

| Number | Date |
|---|---|
| 128,829 | July 2, 1984 |
| 128,781 | July 2, 1984 |
| 128,782 | July 2, 1984 |
| 129,461 | July 26, 1984 |
| 131,111 | September 24, 1984 |
| 131,240 | October 1, 1984 |

These documents concern this application, therefore by separate paper, applicant respectfully requested that the documents be retained and acknowledgment thereof made by the Examiner.

BACKGROUND OF THE INVENTION (1) Field of the Invention

This invention relates to the disposing of cotton burrs from a cotton gin. A cotton ginner or a cotton farmer is one having ordinary skill in the art to which this invention pertains.

Applicant believes the application to be in the field of lignocellulose comminution and classification, and more particularly to comminuting cotton burrs and gin trash and sizing them by screening and classifying a size by air separation.

(2) Description of the Prior Art

As used herein, "lint" is used to refer to the cotton product which has traditionally been spun into yarn and woven into cloth.

The term "harvested cotton" refers to the product that the farmer harvests, which includes seed cotton, burrs, and other trash.

The term "seed cotton" refers to the lint with seed in place.

The term "burrs" represents the woody or fibrous part of the cotton boll which is neither lint nor seed, but does not include bract, leaves or stems.

The term "gin trash" represents everything harvested by the farmer except the lint and seed, and specifically including burrs, stems, limbs, bract and dried leaves. Because of the imperfections of the cleaning process within the gin, the gin trash will contain about 2% by weight of lint.

In certain parts of the U.S., cotton is customarily harvested by stripping. I.e., after the cotton plant is dry, either as the result of frost or chemical action, the cotton bolls are stripped from the plant. In the stripping process, a certain amount of leaves, sticks, and limbs are also taken from the plant, as well as the entire boll, including the burr, lint and seed, and taken to the cotton gin. Traditionally, the cotton has removes the burrs, sticks, limbs, and leaf trash and disposed of them. Then the seed cotton is further processed to lint and seed through the cotton gin. Always, the lint has been a valuable product for cloth. For many years, seed been recognized as a valuable product for the oil and meal.

Normally, the cotton burrs have been considered to be unwanted trash that was difficult to dispose of. The main uses that anyone has been able to put the burrs to have been to burn them as a fuel or to apply them to the soil as a source of humus. Before environmental controls, burrs were burned as a method of disposal. In recent years, they have customarily been distributed to farm fields, more as a method of disposal than for benefit to the fields. Normally, the burrs will be mixed with other trash, including all of the leaves, sticks, and weed seeds. Weed seeds and certain plant diseases carried by the burrs make them less desirable as a source of humus to be returned to the farms.

Some burrs have been used as fiber or roughage in cattle feed. However, the lignocellulose structure of burrs is that of softwoods; therefore, the use in cattle feed is of limited benefit.

Before this application was filed, Applicant caused a search to be made in the U.S. Patent and Trademark Office. The searcher reported the following nine patents:

Gilman, U.S. Pat. No. 81,622
Boyd, U.S. Pat. No. 661,166
Meurling, U.S. Pat. No. 1,123,344
Smith, U.S. Pat. No. 2,718,671
Heritage, U.S. Pat. No. 2,972,171
Goldman, U.S. Pat. No. 3,815,178
Foerster, U.S. Pat. No. 4,102,017
Leinfeld, U.S. Pat. No. 4,150,461
Winch, U.S. Pat. No. 4,300,267

These patents are considered pertinent only because the applicant believes the Examiner would consider anything revealed by the search to be relevant and pertinent to the examination of this application.

SUMMARY OF THE INVENTION (1) New Functions and Surprising Results

I have discovered that the burrs make many useful products. For most useful products, it is necessary to separate lint from the gin trash, and then the gin trash to be comminuted. It is desirable that the gin trash be classified. One type of classification is according to size, which is performed by screening. The second type of classification is by projected surface area and mass which is performed by air classification.

The grinding or comminuting of the burrs, is satisfactorily performed by hammer mill, however, other types of comminution are suitable.

I have found that the separated items have commercial value. The recovered lint is useful as low grade lint for bedding or upholstering. Also, it may be easily dyed and used as a decorative material for decorating department store windows or the like. Furthermore, it is a source of gun cotton. I.e., cellulose to form a raw material for further chemical processing; for example, to be oxidized in a container as a hand warmer.

The ground cotton burrs are useful as an additive or extender to plastics. The particles of the ground burrs have a high percentage of flakes or plates and fibers as opposed to granules. By granules, it is meant a particle wherein the length, width, and thickness are about equal. A flake has a length and width much greater than the thickness. A fiber or fiber bundle has a length much greater than the thickness and width which are about equal. I have found this particular characteristic to be useful in the plastics. With classification, it is possible to obtain even a higher percentage of those particles having a large projected surface area and low mass; or visa versa. The weaker materials, which are more readily crushed, are not found in the finished product since they will be separated before the burrs are comminuted. The comminuted burrs are strong.

The material has a particular chemical structure having a large number of points to which chemical bonds may be made.

The comminuted burrs not used for plastic extenders are easily dyed and used for department store decorations or the like.

The comminuted burrs are also useful in items such as cattle feed and any other items where wood chips or lignocellulose having softwood lignin precursors are used. I.e., it has uses comparable to the uses found for sawdust or wood chips.

(2) Objects of this Invention

An object of this invention is to utilize cotton burrs for a commercial purpose.

Another object of this invention is to separate the various parts of gin trash so that each separate portion can be utilized for its highest economic usage.

Further objects are to comminute and classify cotton burrs.

Other objects are to achieve the above with a method that is versatile, ecologically compatible, energy conserving, rapid, efficient, and inexpensive, and does not require skilled people to install, adjust, operate, and maintain.

Further objects are to achieve the above with a product that is easy to store, has a long storage life, is safe, versatile, efficient, stable and reliable, yet is inexpensive and easy to manufacture.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 6 is a schematic representation of the sizing of the comminuted burrs and other gin trash.

FIG. 7 is a schematic representation of the air classification of one of the sizes of comminuted burrs and other gin trash.

DESCRIPTION OF THE PREFERRED EMBODIMENTS

The drawings, FIGS. 1 through 4, show the basic elements which are used in this invention.

Figure 1:
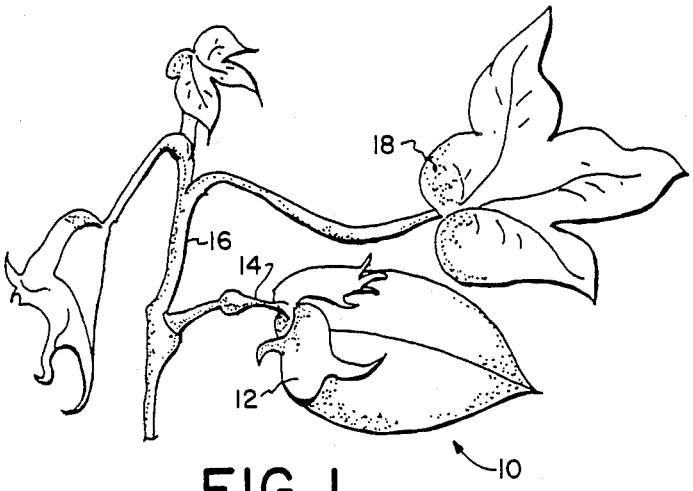
FIG. 1 is a side elevational view of a limb of a cotton stalk with leaves and a green boll thereon.

FIG. 1 shows a green cotton boll 10. The cotton boll will include bract 12 around stem 14. The stem is attached to limb 16 and green leaf 18 is shown therewith.

Figure 2:
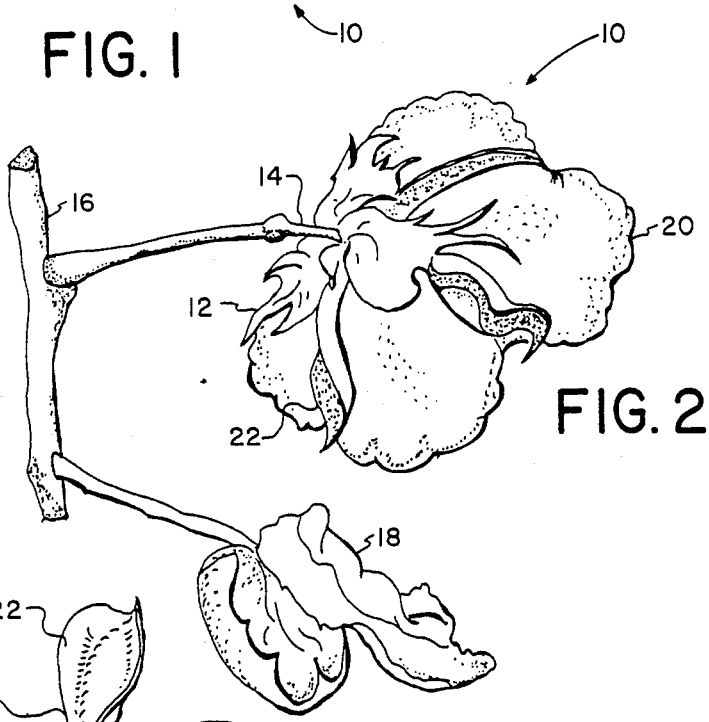
FIG. 2 is a side elevational view of a cotton stalk showing a limb with an open cotton boll and dried leaf thereon.
Figure 3:
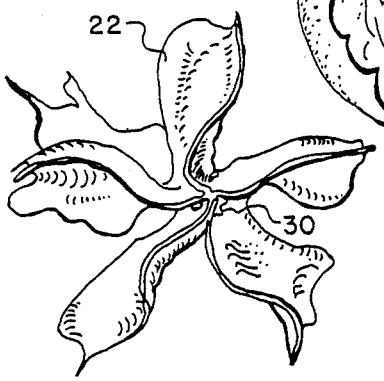
FIG. 3 is a top elevational view of a burr with the seed cotton removed.

When the cotton is ready for harvest, the boll 10 will be open, as shown in FIG. 2, exposing locks 20. Each of the locks 20 will include lint and seed. Normally, at the time of harvest, the bract 12 will be dried and brittle and most of the moisture will be gone from the stems 14 and limb 16. The leaf 18 will be dry and brittle. The burr 22, which was the outer covering of the green boll 10 will be dried. The burr will twist or curl in the drying processes to the shape somewhat typical of that seen in FIGS. 3 and 4.

Figure 4:
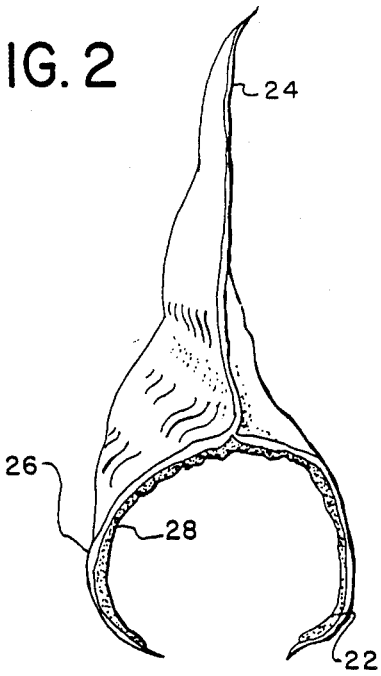
FIG. 4 is a cross sectional view of one section of the cotton burr.

As may be seen in the cross section, FIG. 4, the burr 22 will include partitioning membrane 24, which in the original green cotton boll 10, extended between the adjacent locks 20. Also, there will be a covering membrane 26 over the woody or pithy backing 28 of the burr 22. The pithy or woody backing 28, when dried at harvest time, will be very tough, somewhat similar to weather dried leather. The pithy portion will be brittle, but also very strong. The membranes, 24 and 26, will be very thin and almost translucent but also strong.

The seed cotton (locks of lint and seed) is the commercially valuable product of the cotton plant. Although the harvesting process is to obtain the seed cotton, often commercially, the cotton is stripped from the plant removing the entire boll 10. I.e., the burr 22 and bract 12 will be harvested with the seed cotton. Often, the stem 14, limb 16 and leaf 18 will also be harvested and taken to the gin. At the gin, the leaf 18 will be removed, normally since it is dried, brittle and fragile, it will crumble to form very fine particles or powder by the ginning process itself. Also, the bract will normally be crumbled to fine particles or powder by the ginning process. The limbs, normally after ginning are called the sticks, as well as the stems, are removed from the seed cotton. The burrs are normally broken apart. In nature there will be normally four or five segments for each boll. Normally, no more than two will be attached together at the stem base after processing. Often, a small amount of lint 30 will be still attached to the burrs adjacent to the stem base.

In the most approximate or general terms, a bale of cotton is considered to be 500 pounds of lint. For each bale of cotton there will 800 pounds of seed and about 600 pounds of burrs and other gin trash. Stated otherwise, for each 500 pounds of pure cellulose or lint, for which the cotton was grown, there will be at the cotton gin to be disposed of, 600 pounds of lignocellulose in the form of burrs and other gin trash.

Figure 5:
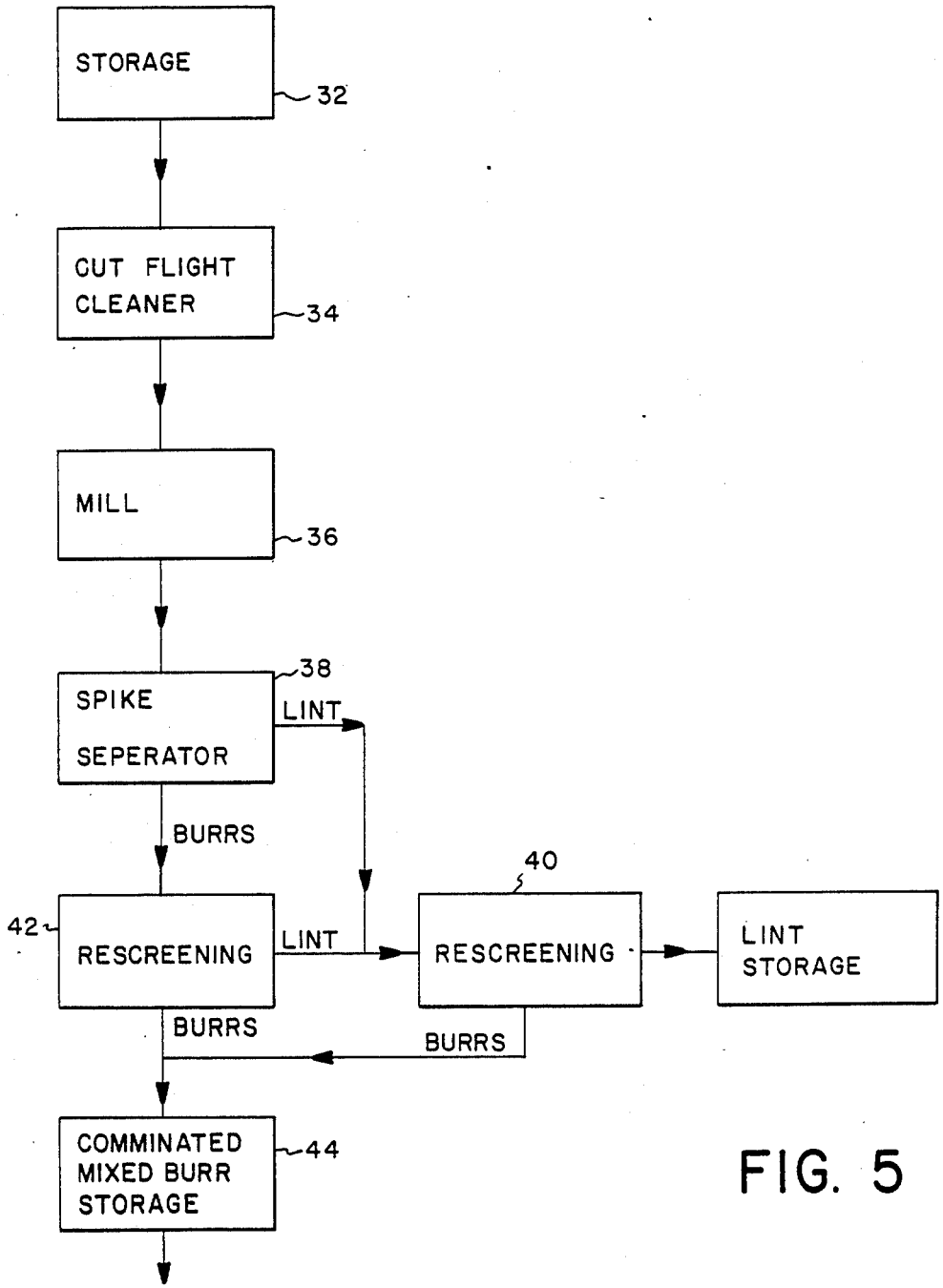
FIG. 5 is a block diagram showing the steps of processing the cotton burrs and other gin trash into lint and comminuted mixed burrs and other gin trash.

According to this invention, the gin trash (burrs, stems, etc.) is gathered and conveyed to a processing point. The gin trash is temporarily stored at the processing point in the pit or bin 32 (FIG. 5). Then, the gin trash is transported by cleaning conveyor 34 to hammer mill 36.

The cleaning conveyor 34 passes the raw gin trash over a small screen to remove the small trash and sand at this point. I have found that a spiral cut flight conveyor within a circular tube works well when the tube is perforated by ⅛" diameter round holes extending radially through the tube. Few sticks or stems drop out and none of the burrs or lint drop out. Sand and fine leaf and bract particles fall out. I.e., only strong, tough material and lint is delivered to the hammer mill. The fragile material that is pulverized in the ginning process, or handling or in the cut flight conveyor will be removed.

By cut flight conveyor, it is meant a conveyor very similar to an auger conveyor, however, instead of having a continuous helical spiral to convey the material along the circular tube, a series of paddle is used. These paddle, each have a beating action to beat the sand and fine particles from the other material. It is desirable that if any of the material is fragile enough to be pulverized, either in the gin or by the cut flight conveyor, that it be eliminated at this point.

The hammer mill 36 is the preferred type of comminutor. However, other comminutors could be used to grind the burrs, sticks and stems, and other gin trash at this point. A conventional hammer mill is used, such as a hammer mill used to grind grain for cattle feed. A conventional hammer mill has particle size adjustment means wherein the comminuted material is expelled from the mill. This expulsion can thus be adjusted so that the material is ground fine or coarse.

The comminuted gin trash is fed from the hammer mill into lint separator 38. The lint separator is the form of a tube formed of woven wire screen with a spike conveyor therein. The spike conveyor is basically the same as an auger conveyor except that instead of a smooth helical flight, there are a series of spikes, about 3" on center, arranged in a helical spiral path around a central shaft which rotates at the axis of the tube.

The tube has about ⅜" square openings inasmuch as it is made of woven wire, the wire being about 1/16" in diameter, there being two wires per inch of both dimensions. Substantially all of the comminuted burrs, stems, and limbs will fall through the screen forming the tube, whereas practically none of the lint will fall through. Therefore, there is an effective separation of the lint from the comminuted separated burrs and trash. However, the lint is fed through lint cleaner spike conveyor 40. The lint cleaner 40 has the same construction, including the same size screen, as the lint separator 38. The lint, after being cleaned is the end product for its use. Stated above, it is then used either for bedding, upholstery, decoration, or is used for its cellulose content as gun cotton.

The comminuted separated burrs and trash from the lint separator 38 are fed to lint reclaimer 42. The construction of the lint reclaimer is the same as the lint separator 38. The purpose of the lint reclaimer is to reclaim or further separate any lint which may have been carried over with the comminuted separated burrs and trash. Any of the lint that has been reclaimed by the lint reclaimer 42 is fed as intake into the lint cleaner 40.

The comminuted separated burrs and trash are then placed in storage. Although I prefer to further size and classify the comminuted separated burrs and trash, it will be understood that there are certain commercial processes that could use them in the mixed form. I.e., that all of the product, except lint, from the hammer mill 36 are mixed together. Therefore, the comminuted mixed separated burrs and trash are placed in storage bin 44 either for further classification or for sale.

After the burrs are comminuted, the separation of lint by lint separator 38, lint reclaimer 42, and lint cleaner 40 will result in the removal of about 2% of the weight of the burrs.

The composition of matter within the storage bin 44 substantially consist of a lignocellulose product having softwood lignin precursors. The material within the bin 44 will be a mixture of comminuted cotton burrs, stems and limbs; substantially free of leaf matter and dirt. Thus, it is shown that the material by weight would be about 74% comminuted cotton burrs, about 24% comminuted cotton stems and limbs, and about lint fibers.

By size, the material in bin 44 will be described by weight as follows:

About 2% of the material will not pass the 6 mesh screen. About 9% of the particles of material will pass the 6 mesh screen but will not pass the mesh screen. About 20% of the particles of material will pass the 10 mesh screen but will not pass the 16 mesh screen. About 22% of the particles of material will pass the 16 mesh screen but will not pass the 30 mesh screen. About 24% of the particles of material will pass the 30 mesh screen but will not pass the 50 mesh screen. As used herein, the term "powder" indicates that material which will pass the 50 mesh screen. Of the 23% of the material that will pass the 50 mesh screen, 13% will not pass the 80 mesh screen. About 6% will pass the 80 mesh screen but will not pass the 100 mesh screen, while about 4% of the material which is in the storage bin 44 will pass the 100 mesh screen.

About 77% of the material will not pass the 50 mesh screen. Of this 77% of the material, about 30% is from stems and limbs in the form of fiber and fiber bundles, about 25% of the material by weight would be burrs in the form of flakes, and about 40% would be burrs, stems, and limbs in the form of granules, and about 3% would be lint.

Also, on taking only 77% of the material which would be retained by the 50 mesh screen and recalculating it, it will be seen of this part that by weight about 2.5% of the particles will not pass the 6 mesh screen, while 12% will pass the 6 mesh screen and not pass the 10 mesh screen, 26% will pass the 10 mesh screen and not pass the 16 mesh screen, 29% will pass the 16 mesh screen and not pass the 30 mesh screen, and 30% will pass the 30 mesh screen and not pass the 50 mesh screen.

After comminuting, analysis is shown that typically the product in the bin 44 will have by weight, about 24% woody fiber and fiber bundles. As discussed above, these will be particles which have a width about equal to the thickness but have a length much longer than their width or thickness. There will be about 20% flakes. As discussed above, these will be particles having width and length which are above equal, but which both are much greater than the thickness. The flakes will result mostly from the membranes 24 and 26. There will be about 31% of granular material. About 23% will be powder. The granular material will have a thickness, length, and width all of about equal amount. In addition to this, there will be about 2% "nits" or particles of lint which are not connected as fiber, and therefore, not adhered the different particles of lint not connected together but individual strands or truly individual fibers of the pure cellulose that is otherwise the cotton lint. Since they are individual, they screen and separate as particles rather than the cotton lint which is separated by the lint separator 38.

I prefer, after the removal or separation of the lint, to size the particles. I prefer to do this by screening, by screens 46, into different sizes; namely, those that are retained by 6×6 screen (it will be remembered that all of the particles pass through a 2×2 screen in the lint separation). Therefore, the size of these particles will be minus 2 plus 6, meaning they are smaller than a 2×2 screen, but larger than a 6×6 screen.

The next size would be a minus 6 plus 10, meaning those particles that pass through a 6×6 screen but are retained by a 10×10 screen. The next size would be a minus 10 plus 16. I.e., those particles that passed the 10×10 screen but are retained by a 16×16 screen. Other groups of particles that would be minus 16 plus 30; minus 30 plus 50; minus 50 plus 80; minus 80 plus 100; and minus 100. Stated above, these particles for resemble dust that they do particles. Finally, there would be very fine dust that would pass through a screen having 100 wires per inch.

The screen designations are all standard designation of screens for the sizing of particles.

It has been found that the different sized particles are suitable for different purposes. The sizing by screens is a well understood process not discussed further at this point.

After the particles have been sized, it is desirable to classify them by air classification. The air classification will classify them according to surface area and mass, and more particularly by projected surface area. Those having the greatest mass and the least surface area will fall first, and those having the greatest surface area and the least mass will fall last. One method of air classification means 48 is shown. The material is dropped through a horizontal air stream as produced by a fan. Then, the different sizes can be separated according to the distance they travel along the air stream.

Like the sizing operation, the air classification is standard process and understood. By air classification, it is possible to get a product that is composed almost entirely of flakes on the furthest blown element and also a product that is almost entirely granules that drop first. Other particular particle characteristics are separated between the two extremes.

The different air classified particles and different sized particles have been found very useful as plastic extenders. It has been found that 80% of the ground material can be added to the thermosetting and 20% plastics. Also, it has been found that this extender actually increases the strengths of products molded from the plastic. I.e., it acts as a reinforcement. It will be remembered, as discussed above, that the particles have large percentages of each of the three different geometric shapes; i.e., granules, fibers, and flakes. In addition to this, the chemical composition of the material is such that there are many connection points which form chemical bonds to the plastics.

It will also be understood the air classification could be done on the mixture of sizes, and that it is not necessary to do each size of air classification separately.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific examples above do not point out what an infringement of this patent would be, but are to enable one skilled in the art to make and use the invention.

As an aid to correlating the terms of the claims to the exemplary drawing, the following catalog of elements and steps is provided:

10 Cotton Boll
12 Bract
14 Stem
16 Limb
18 Leaf
20 Lock
22 Burr
24 Membrane
26 Cover Membrane
28 Backing
30 Lint
32 Bin
34 Cleaning Conveyor
36 Hammer Mill
38 Lint Separator
40 Lint Cleaner
42 Lint Reclaimer
44 Comminuted Storage
46 Screens
48 Air Classify

I claim as my invention:

1. The process of treating cotton burrs with other trash and lint which have been extracted from harvested cotton in a cotton gin; comprising the steps of:

a. screening the burrs, lint, and trash thus
b. cleaning sand and other fine material therefrom, thereafter
c. comminuting the burrs into comminuted burrs and trash, and thereafter,
d. separating the lint from the comminuted separated burrs and trash by
e. passing the comminuted burrs and trash through a coarse screen which retains the lint.

2. The invention as defined in claim 1 further comprising:

f. air classifying the comminuted burrs and trash.

3. The invention as defined in claim 1 further comprising:

f. rescreening the comminuted burrs and trash as separated at step e. above to remove additional lint therefrom.

4. The invention as defined in claim 1 further comprising:

f. rescreening the lint separated above at step e. to remove additional comminuted burrs and trash therefrom.

5. The invention as defined in claim 4 further comprising:

g. rescreening the comminuted burrs and trash as separated at step e. above to remove additional lint therefrom.

6. The invention as defined in claim 1 wherein the screen separation of step e. above is by:

f. forming coarse woven wire mesh screen into a tube,
g. placing the comminuted burrs, lint and other trash within the tube, and
h. conveying the material through said tube by use of a helical spike auger conveyor so that the lint because of its lint characteristics is conveyed through the tube and the comminuted burrs and trash fall through the tube.

7. The invention as defined in claim 1 further comprising:

f. sizing the separated comminuted burrs and trash into sizes by
g. screening them through a series of screens having selectively smaller meshes.

8. The invention as defined in claim 7 further comprising:

h. air classifying at least one of the sizes.

9. The invention as defined in claim 8 further comprising:

i. rescreening the lint separated above at step e. to remove additional comminuted burrs and trash therefrom.

10. The invention as defined in claim 9 further comprising:

j. rescreening the comminuted burrs and trash as separated at step e. above to remove additional lint therefrom.

11. The invention as defined in claim 10 wherein the screen separation of step e. above is by:

k. forming coarse woven wire mesh screen into a tube, l. placing the comminuted burrs, lint and other trash within the tube, and m. conveying the material through said tube by use of a helical spike auger conveyor so that the lint because of its lint characteristics is conveyed through the tube and the comminuted burrs and trash fall through the tube.

* * * * *